US005882180A

United States Patent [19]

Kawaguchi et al.

[11] Patent Number: 5,882,180

[45] **Date of Patent: *Mar. 16, 1999**

[54] OIL MIST FILTER IN A VARIABLE DISPLACEMENT COMPRESSOR

[75] Inventors: Masahiro Kawaguchi; Masanori Sonobe; Yoshihiro Makino, all of Aichi-ken, Japan

[73] Assignee: Kabushiki Kaisha Toyoda Jidoshokki Seisakusho, Kariya, Japan

[ * ] Notice: This patent issued on a continued prosecution application filed under 37 CFR 1.53(d), and is subject to the twenty year patent term provisions of 35 U.S.C. 154(a)(2).

[21] Appl. No.: 788,459

[22] Filed: Jan. 28, 1997

[30] Foreign Application Priority Data

Feb. 1, 1996 [JP] Japan ..... 8-016757

[51] Int. Cl.[6] ..... F04B 1/26

[52] U.S. Cl. ..... 417/222.2; 417/313; 417/423.9; 92/78

[58] Field of Search ..... 417/222.2, 312, 417/313, 423.9, 269, 270; 92/78; 91/499, 505

[56] References Cited

U.S. PATENT DOCUMENTS 1,162,851 12/1915 Dewson ..... 92/78
5,242,274 9/1993 Inoue ..... 417/222.2
5,636,973 6/1997 Sonobe et al. ..... 417/222.2

FOREIGN PATENT DOCUMENTS 4344818 7/1994 Germany .
19514376 10/1995 Germany .
6336978 12/1994 Japan .

*Primary Examiner*—Timothy S. Thorpe
*Assistant Examiner*—Cheryl J. Tyler
*Attorney, Agent, or Firm*—Morgan & Finnegan, L.L.P.

[57] ABSTRACT

A compressor having a cam plate disposed in a crank chamber and mounted on a drive shaft. The cam plate is tiltable between a maximum inclined angle position and a minimum inclined angle position with respect to a plane perpendicular to an axis of the drive shaft according to a differential pressure in the crank chamber and in a cylinder bore. The cam plate varies the stroke of a piston based on an inclination thereof to control the displacement of the compressor. A supply passage connects a discharge chamber with the crank chamber to deliver the gas from the discharge chamber to the crank chamber. The supply passage has an inlet that is open in the discharge chamber. A control valve is disposed midway on the supply passage. The control valve adjusts the amount of the gas introduced into the crank chamber from the discharge chamber through the supply passage to control the pressure in the crank chamber. A filter is disposed at the inlet of the supply passage to filter the oil. The filter captures foreign matter mixed with the oil when the gas containing the oil is introduced into the supply passage from the discharge chamber.

23 Claims, 4 Drawing Sheets

OIL MIST FILTER IN A VARIABLE DISPLACEMENT COMPRESSOR

BACKGROUND OF THE INVENTION

1. Field of the Invention

The present invention relates to variable displacement compressors that are used in vehicle air conditioners. More particularly, the present invention relates to a variable displacement compressor that changes its discharge displacement by adjusting the inclination of a cam plate.

2. Description of the Related Art

Variable displacement compressors typically have a cam plate that is tiltably supported on a rotary shaft. The inclination of the cam plate is controlled based on the difference between the pressure in a crank chamber and the pressure in cylinder bores. The stroke of each piston is varied by the inclination of the cam plate. The crank chamber is communicated with a discharge chamber by a supply passage. A displacement control valve is located midway in the supply passage. The displacement control valve controls the amount of refrigerant gas introduced into the crank chamber from the discharge chamber.

Opening the control valve allows refrigerant gas to flow into the crank chamber from the discharge chamber via the supply passage. This increases the pressure in the crank chamber, thereby increasing the difference between the pressure in the crank chamber and the pressure in the cylinder bores. This minimizes the inclination of the cam plate. Accordingly, the displacement of the compressor becomes minimized. On the other hand, closing the control valve stops the flow of refrigerant gas from the discharge chamber to the crank chamber. This reduces the pressure in the crank chamber, thereby decreasing the difference between the pressure in the crank chamber and the pressure in the cylinder bores. This maximizes the inclination of the cam plate. Accordingly, the displacement of the compressor becomes maximized.

During operation, sliding parts in compressors often abrade one another and thus generate metal powder. High temperature and pressure accompanying gas compression often carbonize lubricant, thereby generating carbide in the compressor. In many variable displacement compressors, a control valve located midway in a supply passage includes an aperture that opens and closes for selectively allowing and stopping the flow of refrigerant gas. The cross-sectional area of the aperture is extremely small. Refrigerant gas passing through the opening of the valve contains lubricant oil. Therefore, if foreign matter such as metal powder and carbide is mixed with the lubricant oil, the foreign matter may choke the aperture. The choked aperture disables the displacement control by the control valve.

Variable displacement compressors often have a rotary shaft directly connected to an external drive source such as an engine without a clutch located in-between. In this clutchless system, when the control valve is opened such that the compressor operates at the minimum displacement, refrigerant gas flow from an external refrigerant circuit into the compressor is stopped. However, refrigerant gas continues to circulate within the compressor. Lubricant oil contained in the refrigerant gas also circulates within the compressor and is not discharged to the external refrigerant circuit. Therefore, if foreign matter is mixed with the lubricant oil, the circulation of the lubricant oil abrades sliding parts in the compressor. Further, if foreign matter chokes the aperture of the control valve, the compressor continuously operates at a large displacement even when cooling is not needed. That is, the air conditioner becomes uncontrollable.

In order to solve the above drawback, some variable displacement compressors are equipped with a filter at the inlet of the control valve. The filter filters out foreign matter such as metal powder and carbide mixed with lubricant oil in refrigerant gas when the gas flows from the supply passage to the control valve.

If the filter is choked with foreign matter, the flow of refrigerant gas in the supply passage will be restricted, and the displacement of the compressor cannot be accurately controlled. Therefore, foreign matter accumulated on the filter needs to be removed. However, since the filter is located at the inlet of the control valve located midway in the supply passage, the control valve needs to be detached from the compressor in order to remove foreign matter from the filter. This makes filter cleaning burdensome. Also, since the supply passage is narrowly formed, foreign matter is likely to accumulate on the filter.

SUMMARY OF THE INVENTION

Accordingly, it is an objective of the present invention to provide a compressor having a filter that positively filters foreign matter mixed in lubricant oil. Further, the compressor automatically removes the foreign matter on the filter.

To achieve the above objects, the compressor according to the present invention has a cam plate disposed in a crank chamber and mounted on a drive shaft and a piston coupled to the cam plate and disposed in a cylinder bore. The cam plate converts rotation of the drive shaft to reciprocating movement of the piston in the cylinder bore to vary the capacity of the, cylinder bore. The piston compresses a gas supplied to the cylinder bore from an external circuit by way of a suction chamber and discharges the compressed gas to a discharge chamber. The gas contains oil that lubricates the interior of the compressor. The cam plate is tiltable between a maximum inclined angle position and a minimum inclined angle position with respect to a plane perpendicular to the longitudinal axis of the drive shaft according to a differential pressure in the crank chamber and in the cylinder bore. The cam plate varies the stroke of the piston based on the inclination thereof to control the displacement of the compressor. A supply passage connects the discharge chamber with the crank chamber to deliver gas from the discharge chamber to the crank chamber. The supply passage has an inlet that is open in the discharge chamber. A control valve is disposed midway in the supply passage. The control valve adjusts the amount of the gas introduced into the crank chamber from the discharge chamber through the supply passage to control the pressure in the crank chamber. A filter is disposed at the inlet of the supply passage to filter the oil. The filter captures foreign matter mixed with the oil when the gas is introduced into the supply passage from the discharge chamber.

BRIEF DESCRIPTION OF THE DRAWINGS

The features of the present invention that are believed to be novel are set forth with particularity in the appended claims. The invention together with objects and advantages thereof, may best be understood by reference to the following description of the presently preferred embodiments together with the accompanying drawings in which:

DETAILED DESCRIPTION OF THE PREFERRED EMBODIMENTS

A first embodiment of a variable displacement compressor according to the present invention will now be described with reference to FIGS. 1 to 3.

Figure 1:
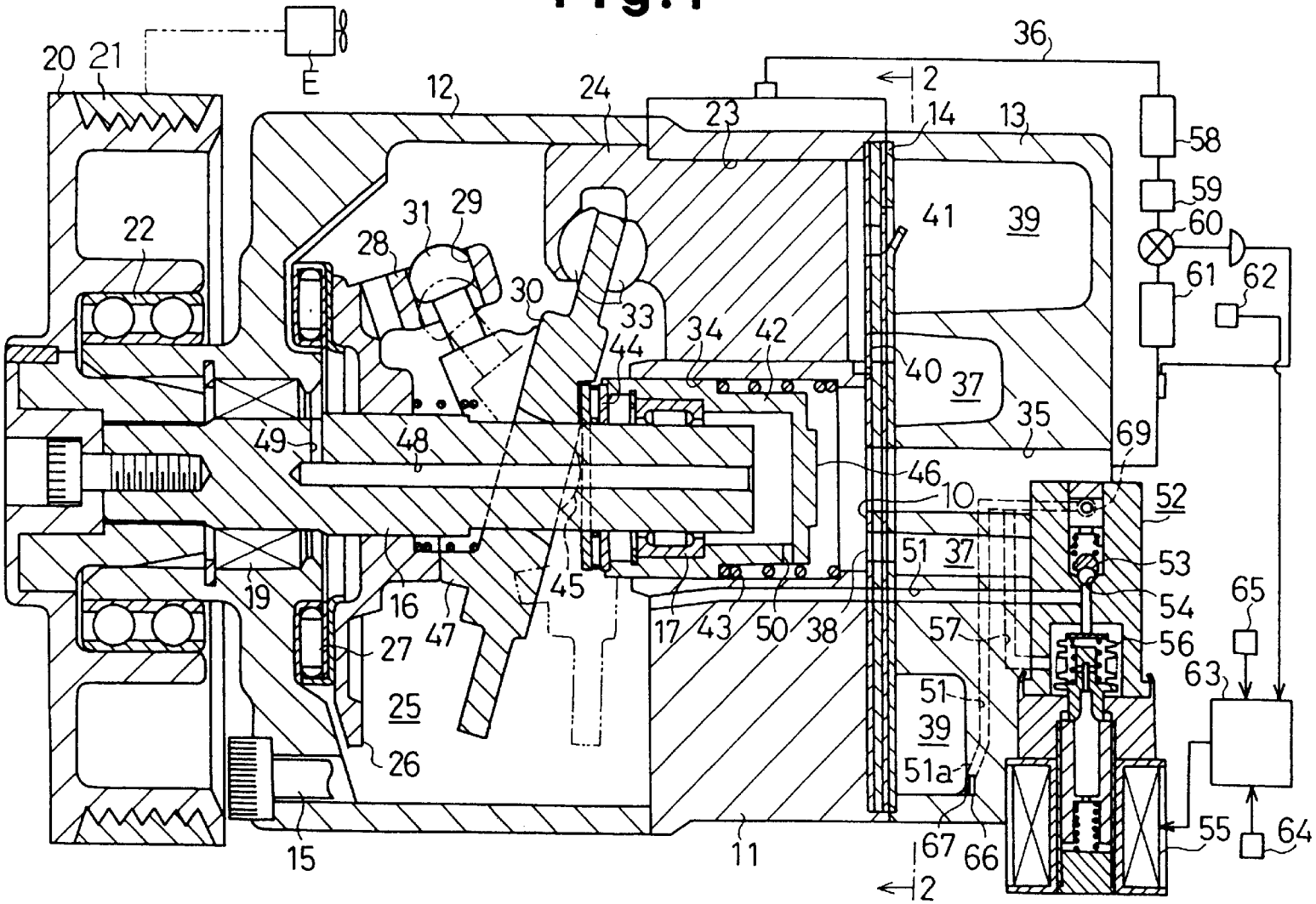
FIG. 1 is a cross-sectional view illustrating a variable displacement compressor according to a first embodiment of the present invention.
Figure 2:
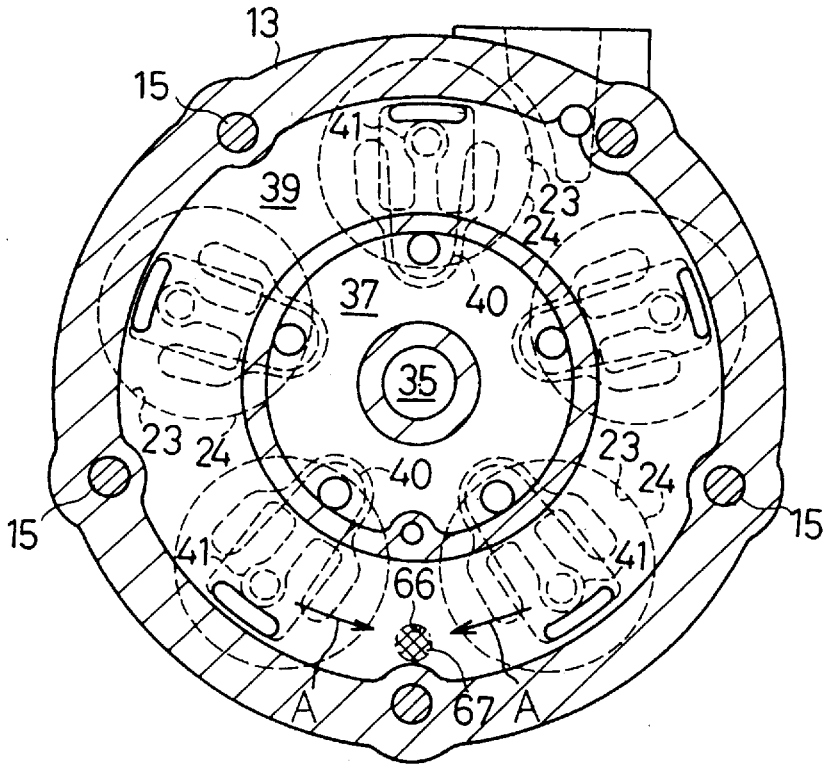
FIG. 2 is a cross-sectional view taken along line 2—2 of FIG. 1.

As shown in FIGS. 1 and 2, a cylinder block 11 constitutes a part of a compressor. A front housing 12 is secured to the front end face of the cylinder block 11. A rear housing 13 is secured to the rear end face of the cylinder block 11 with a valve plate 14 provided in-between.

A crank chamber 25 is defined by the inner walls of the front housing 12 and the front end face of the cylinder block 11. A plurality of bolts 15 extend through the front housing 12, the cylinder block 11, and the valve plate 14. The bolts 15 are screwed into the rear housing 13. The bolts 15 fix the front housing 12 and the rear housing 13 to the front end face and the rear end face of the cylinder block 11.

A rotary shaft 16 is rotatably supported by a radial bearing 17 and extends through the center of the cylinder block 11 and the front housing 12. A lip seal 19 is located between the rotary shaft 16 and the front housing 12. The lip seal 19 seals the crank chamber 25. The front end of the rotary shaft 16 is secured to a pulley 20. The pulley 20 is directly coupled to an external drive source (a vehicle's engine E in this embodiment) by a belt 21. The compressor according to this embodiment is a clutchless type variable displacement compressor having no clutch between the rotary shaft 16 and the external drive source. An angular bearing 22 is placed between the pulley 20 and the front housing 12. The angular bearing 22 carries thrust and radial loads that act on the pulley 20.

A substantially disk-like swash plate 30 is supported by the rotary shaft 16 in the crank chamber 25 in such a way as to be slidable along and tiltable with respect to the axis of the shaft 16. The swash plate 30 is provided with a pair of guiding pins 31, each having a spherical body at its distal end. A rotor 26 is fixed to the rotary shaft 16 in the crank chamber 25. The rotor 26 rotates integrally with the rotary shaft 16. A thrust bearing 27 is arranged between the rotor 26 and the front housing 12. The rotor 26 has a pair of support arms 28 protruding toward the swash plate 30. A guide hole 29 is formed in each arm 28. Each guide pin 31 is slidably fit into the corresponding guide hole 29. The cooperation of the arm 28 and the guide pins 31 permits the swash plate 30 to rotate together with the rotary shaft 16. The cooperation also guides the tilting of the swash plate 30 and the movement of the swash plate 30 along the axis of the rotary shaft 16.

A plurality of cylinder bores 23 are formed extending through the cylinder block 11 about the rotary shaft 16. The bores 23 are arranged parallel to the axis of the rotary shaft 16 with a predetermined interval between each adjacent bore 23. A single-headed piston 24 is housed in each bore 23. A pair of semispherical shoes 33 are fit between each piston 24 and the swash plate 30. A semispherical portion and a flat portion is defined in each of the shoes 33. The semispherical portion slidably contacts the piston 24 while the flat portion slidably contacts the swash plate 30. The swash plate 30 rotates integrally with the rotary shaft 16. The rotating movement of the swash plate 30 is transmitted to each piston 24 through the shoes 33 and converted to a linear reciprocating movement of each piston 24 in the associated cylinder bore 23.

A shutter chamber 34 is defined in the center of the cylinder block 11, extending along the axis of the rotary shaft 16. A suction passage 35 is defined in the center portion of the rear housing 13 and the valve plate 14, extending along the axis of the rotary shaft 16. The suction passage 35 is communicated with the shutter chamber 34. The suction passage 35 is connected to an external refrigerant circuit 36. An annular suction chamber 37 is defined in the rear housing 13. The suction chamber 37 is communicated with the shutter chamber 34 via a communication hole 38. An annular discharge chamber 39 is defined around the suction chamber 37 in the rear housing 13. The discharge chamber 39 is connected to the external refrigerant circuit 36.

Suction valve mechanisms 40 are formed on the valve plate 14. Each suction valve mechanism 40 corresponds to one of the cylinder bores 23. As each piston 24 moves from the top dead center to the bottom dead center in the associated cylinder bore 23, refrigerant gas in the suction chamber 37 is drawn into the cylinder bore 23 through the associated suction valve mechanism 40. Discharge valve mechanisms 41 are formed on the valve plate 14. Each discharge valve mechanism 41 corresponds to one of the cylinder bores 23. As each piston 24 moves from the bottom dead center to the top dead center in the associated cylinder bore 23, refrigerant gas is compressed in the cylinder bore 23 and discharged to the discharge chamber 39 through the associated discharge mechanism 41.

A hollow cylindrical shutter 42 is accommodated in the shutter chamber 34 in such a way as to be slidable along the axis of the rotary shaft 16. A coil spring 43 is located between the shutter 42 and the inner wall of the shutter chamber 34. The coil spring 43 urges the shutter 42 toward the swash plate 30. The rear end of the rotary shaft 16 is inserted in the shutter 42. The radial bearing 17 is located between the rear end of the rotary shaft 16 and the inner wall of the shutter 42. The radial bearing 17 receives radial loads applied to the rotary shaft 16. The radial bearing 17 is fixed to the inner wall of the shutter 42. Therefore, the radial bearing 17 moves with the shutter 42 axially along the rotary shaft 16.

A thrust bearing 44 is located between the shutter 42 and the swash plate 30 in such a way as to be slidable axially along the rotary shaft 16. A pair of protrusions 45 are formed on the rear end surface of the swash plate 30. Each protrusion 45 is semispherical and contacts the front race of the thrust bearing 44. The thrust bearing 44 receives thrust loads acting on the shutter 42 by tilting and rotation of the swash plate 30.

A positioning surface 10 is formed on the valve plate 14 between the shutter chamber 34 and the suction passage 35. The rear end face of the shutter 42 forms a shutting surface 46. The shutting surface 46 is engageable with the positioning surface 10.

As the swash plate 30 slides backwards, its inclination becomes small. As the swash plate 30 slides backward, it pushes the shutter 42 with the thrust bearing 44. This moves the shutter 42 against the tension of the coil spring 43 toward the positioning surface 10. When the swash plate 30 reaches the minimum inclination as illustrated by two-dot chain lines in FIG. 1, the shutting surface 46 of the shutter 42 contacts the positioning surface 10 and becomes located at a closed position. At the closed position, the shutter 42 disconnects the suction passage 35 from the shutter chamber 34. This prevents the swash plate 30 from further inclining from the minimum inclination and stops the flow of refrigerant gas from the external refrigerant circuit 36 to the suction chamber 37. This allows the displacement of the compressor to become minimum. The minimum inclination of the swash plate 30 is slightly larger than zero degrees. Zero degrees refers to the angle of the swash plate's inclination when it is perpendicular to the axis of the rotary shaft 16.

As the swash plate 30 moves from the minimum inclination position illustrated by the two-dot chain lines toward the maximum inclination illustrated by solid lines in FIG. 1, the shutter 42 is separated from the positioning surface 10 by the coil spring 43. The shutter 42 comes to an opening position to communicate the suction passage 35 with the shutter chamber 34. This draws the refrigerant gas into the suction chamber 37 from the external refrigerant circuit 36 via the suction passage 35. Accordingly, the displacement of the compressor becomes maximal. The abutment of a projection 47 projecting from the front end face of the swash plate 30 against the rotor 26 prevents the inclination of the swash plate 30 beyond the predetermined maximum inclination.

A pressure release passage 48 is defined in the central portion of the rotary shaft 16. The passage 48 has an inlet 49 connected with the crank chamber 25 and an outlet connected with the interior of the shutter 42. The inlet 49 is located in the vicinity of the lip seal 19. A pressure release hole 50 is formed in the peripheral wall near the rear end of the shutter 42. The hole 50 communicates the interior of the shutter 42 with the shutter chamber 34. Refrigerant gas in the crank chamber 25 is released into the suction chamber 37 through the pressure release passage 48, the interior of the shutter 42, pressure release hole 50, the shutter chamber 34, and the communication hole 38.

A supply passage 51 is defined in the rear housing 13, valve plate 14, and the cylinder block 11. The supply passage 51 connects the discharge chamber 39 with the crank chamber 25. A displacement control valve 52 is arranged in the rear housing 13 and located midway in the supply passage 51. The control valve 52 includes a valve body 53, a solenoid 55 and a bellows 56. The valve body 53 is actuated by the solenoid 55 to selectively open and close a valve hole 54. The bellows 56 controls the amount of opening defined by the valve body 53 and the valve hole 54.

When the solenoid 55 is excited, the valve body 53 closes the valve hole 54. When the solenoid 55 is de-excited, the valve body 53 opens the valve hole 54. This allows refrigerant gas in the discharge chamber 39 to flow into the crank chamber 25 via the supply passage 51. The suction pressure in the suction passage 35 is introduced to the space around the bellows 56 via a passage 57. When the solenoid 55 is excited, the opening of the hole 54 defined by the valve body 53 is controlled based on the suction pressure acting on the bellows 56. That is, the flow of refrigerant gas from the discharge chamber 39 to the crank chamber 25 is controlled in accordance with the suction pressure acting on the bellows 56. The pressure in the crank chamber 25 is controlled, accordingly.

The external refrigerant circuit includes a condenser 58, a receiver 59, an expansion valve 60 and an evaporator 61. The expansion valve 60 controls the flow rate of the refrigerant in accordance with the fluctuation of gas temperature at the outlet side of the evaporator 61. A temperature sensor 62 is located in the vicinity of the evaporator 61. The temperature sensor 62 detects the temperature of the evaporator 61 and sends data of the detected temperature to a computer 63. The computer 63 is connected to a switch 64 and a revolution speed detector 65. The switch 64 activates the air conditioner and the revolution speed detector 65 detects the speed of the engine E.

When the switch 64 is turned on, the computer 63 de-excites the solenoid 55 in the control valve 52 if the temperature sensed by the temperature sensor 62 becomes equal to or lower than a predetermined temperature. This opens the valve hole 54, thereby preventing frost in the evaporator 61. When the switch 64 is turned on, the computer 63 de-excites the solenoid 55 based on certain data of the detected speed fluctuation sent from the speed revolution speed detector 65. This opens the valve hole 54. The computer 63 also de-excites the solenoid 55 when the switch 64 is turned off.

Figure 3:
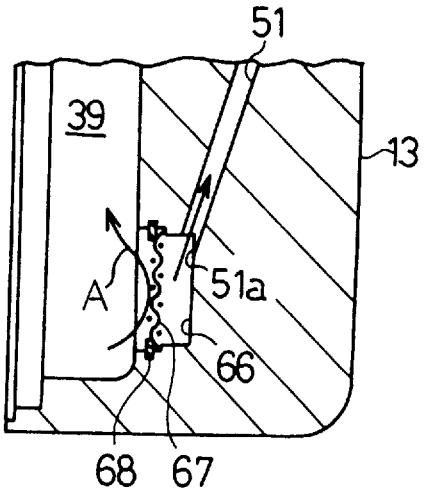
FIG. 3 is an enlarged partial cross-sectional view illustrating the inlet of a supply passage.

As shown in FIGS. 1 to 3, a recess 66 is formed on the inner wall of the discharge chamber 39 to be located in the vicinity of the chamber's bottom. The supply passage 51 has an inlet 51*a*, which opens into the recess 66. In other words, the inlet 51*a* of the supply passage 51 opens near the bottom of the discharge chamber 39 via the recess 66. A first filter 67 is located in the recess 66 by a retaining ring 68 in such a way as to be substantially flush with the wall of the discharge chamber 39. The opening area of the recess 66 12 (in other words, the area of the first filter 67) is larger than the cross sectional area of the supply passage 51. This prevents the first filter 67 from restricting the amount of refrigerant gas drawn into the supply passage 51 from the discharge chamber 39. Further, the large area of the first filter 67 facilitates its maintenance. A second filter 69 is located at the inlet of the control valve 52. The second filter 69 has a finer mesh than that of the first filter 67.

When the valve body 53 in the control valve 52 opens the valve hole 54, refrigerant gas in the discharge chamber 39 is drawn into the crank chamber 25 via the supply passage 51. Foreign matter such as metal powder and carbide mixed with lubricant oil contained in the refrigerant gas is captured by the filters 67, 69. On the other hand, when the valve body 53 closes the valve hole 54, the compressor operates at the maximum displacement. At this time, refrigerant gas flows along the surface of the first filter 67 as illustrated by arrows A in the discharge chamber 39 as shown in FIGS. 2 and 3. The gas flow removes the foreign matter accumulated on the first filter 67. The removed foreign matter is discharged to the external refrigerant circuit 36 by the gas flow from the discharge chamber 39 to the external refrigerant circuit 36.

The operation of the above described variable displacement compressor will now be described.

FIG. 1 shows the state in which the solenoid 55 is excited to allow the valve body 53 to close the valve hole 54. The supply passage 51 is closed. Therefore, high pressurized refrigerant gas in the discharge chamber 39 is not supplied to the crank chamber 25. The refrigerant gas in the crank chamber 25 is drawn into the suction chamber 37 via the pressure release passage 48 and the pressure release hole 50. This allows the pressure in the crank chamber 25 to approach the low pressure in the suction chamber 37, that is, to approach the suction pressure. Accordingly, the difference between the pressure in the crank chamber 25 and the pressure in the cylinder bores 23 becomes smaller. This maximizes the inclination of the swash plate 30, thereby allowing the compressor to operate at the maximum displacement.

When the solenoid 55 of the control valve 52 is excited, the opening of the valve hole 54 defined by the valve body 53 is adjusted based on the suction pressure acting on the bellows 56. This changes the difference between the pressure in the crank chamber 25 and the pressure in the cylinder bores 23. This adjusts the displacement of the compressor, thereby controlling the refrigerant capacity of the air conditioner.

When the refrigerant capacity becomes excessive because of the decrease in cooling load, the temperature of the evaporator 61 in the external refrigerant circuit 36 gradually decreases. The computer 63 de-excites the solenoid 55 in the control valve 52 based on data from the temperature sensor 62 indicating that the evaporator's temperature has dropped to the frost forming temperature. De-exciting of the solenoid 55 allows the valve body 53 to open the valve opening 54. Consequently, high pressurized refrigerant gas in the discharge chamber 39 is drawn into the crank chamber 25 via the supply passage 51. The pressure in the crank chamber 25 increases, accordingly. This enlarges the difference between the pressure in the crank chamber 25 and the pressure in the cylinder bores 23, thereby causing the swash plate 30 to change from the maximum inclination to the minimum inclination. The compressor then starts operating at the minimum displacement.

As the swash plate 30 becomes less inclined, the swash plate 30 moves the shutter 42 with the thrust bearing 44 toward the positioning surface 10. Abutment of the shutting surface 46 of the shutter 42 against the positioning surface 10 disconnects the suction chamber 37 from the suction passage 35. This stops the gas flow from the external refrigerant circuit 36 into the suction chamber 37. Accordingly, the circulation of refrigerant gas between the refrigerant circuit 36 and the compressor is stopped.

When the shutter 42 abuts the positioning surface 10, the inclination of the swash plate 30 becomes minimal. Being slightly larger than zero degrees, the minimum inclination of the swash plate 30 discharges refrigerant gas from the cylinder bores 23 to the discharge chamber 39, thereby allowing the compressor to operate at the minimum displacement. The refrigerant gas discharged into the discharge chamber 39 is drawn into the cylinder bores 23 via the supply passage 51, the crank chamber 25, the pressure release passage 48, the pressure release hole 50 and the suction chamber 37. That is, when the inclination of the swash plate 30 is minimum, refrigerant gas circulates within the compressor traveling through the discharge chamber 39, the supply passage 51, the crank chamber 25, the pressure release passage 48, the pressure release hole 50, the suction chamber 37 and the cylinder bores 23. This circulation of gas allows the lubricant oil contained in the gas to lubricate each sliding part in the compressor.

The inlet 51*a* of the supply passage 51 opens near the bottom of the discharge chamber 39 via the recess 66. Therefore, lubricant oil stored at the bottom of the discharge chamber 39 is drawn into the supply passage 51 through the inlet 51*a* with refrigerant gas by the difference of the pressure in the discharge chamber 39 and the pressure in the crank chamber 25 and then circulates within the compressor. In this manner, lubricant oil is sufficiently supplied to each part of the compressor even if the inclination of the swash plate 30 is minimum.

When the compressor is operating at the minimum displacement, foreign matter such as metal powder and carbide mixed with the lubricant oil in the refrigerant gas is captured by the first filter 67 located at the inlet 51*a* of the supply passage 51. Finer foreign matter that penetrates the first filter 67 is captured by the second filter 69 located at the inlet of the control valve 52.

If the cooling load of the compressor increases when the compressor is operating with the swash plate 30 minimally inclined, the temperature of the evaporator 61 in the external refrigerant circuit 36 gradually increases. When the temperature of the evaporator 61 exceeds the frost forming temperature, the computer 63 excites the solenoid 55 in the control valve 52 based on data from the temperature sensor 62. Exciting of the solenoid 55 moves the valve body 53 to close the valve hole 54. This stops the gas flow from the discharge chamber 39 into the crank chamber 25. The refrigerant gas in the crank chamber 25 is drawn into the suction chamber 37 via the pressure release passage 48 and the pressure release hole 50. This gradually decreases the pressure in the crank chamber 25, thereby changing the inclination of the swash plate 30 from the minimal to the maximal.

As the swash plate 30 becomes more inclined, the shutter 42 slowly separates from the positioning surface 10 by the force of the coil spring 43. The separation of the shutter 42 slowly increases the flow rate of refrigerant gas from the external refrigerant circuit 36 to the suction chamber 37 via the suction passage 35. Accordingly, the flow rate of the gas drawn into the cylinder bores 23 from the suction chamber 37 gradually increases. This gradually increases the displacement of the compressor. When the swash plate 30 reaches the maximum inclination as illustrated by solid lines in FIG. 1, the compressor starts operating at the maximum displacement.

When the compressor is operating at the maximum displacement, refrigerant gas in the discharge chamber 39 flows substantially along the face of the first filter 67 as illustrated by the arrows A in FIGS. 2 and 3. Therefore, foreign matter accumulated on the first filter 67 is exposed to the gas flow in the discharge chamber 39. This removes the foreign matter from the first filter 67. The removed foreign matter is then discharged into the external refrigerant circuit 36 with refrigerant gas and is thereafter captured by a filter (not shown) provided in the receiver 59. Since the structure of the receiver 59 is fairly simple, that is, the receiver 59 has no actuating parts, the filter is easily detached from the receiver 59. Therefore, the foreign matter on the filter of the receiver 59 is easily removed.

The above described first embodiment has the following advantages:

(1) When the compressor is operating with the supply passage 51 open, foreign matter such as metal powder and carbide mixed with lubricant oil is captured by the first filter 67 located at the inlet 51*a* of the supply passage 51. This prevents the foreign matter from choking the narrow passage defined by the valve body 53 and the valve hole 54 in the control valve 52. Displacement control by the control valve 52 is thus ensured. Accordingly, the compressor reliably operates at the minimum displacement when cooling is unnecessary. When the compressor is operating at the minimum displacement, refrigerant gas and lubricant oil contained therein circulate within the compressor. At this state, the circulation of foreign matter mixed with the lubricant oil, which would otherwise accelerate abrasion of the sliding parts in the compressor, is stopped by the first filter 67. This improves the durability of the compressor's sliding parts.

(2) When the compressor is operating with the supply passage 51 closed, the gas flow in the discharge chamber 39 removes foreign matter accumulated on the first filter 67. The first filter 67 is cleaned without detaching the control valve 52 from the compressor. Clogging of the first filter 67 is thus prevented.

(3) The first filter 67 is arranged substantially flush with the wall of the discharge chamber 39. In other words, the first filter 67 is arranged along the gas flow in the discharge chamber 39 when the compressor is operating with the supply passage 51 closed. This allows the gas flow in the discharge chamber 39 to efficiently remove foreign matter on the first filter 67. Cleaning of the first filter 67 is improved in this manner.

Figure 4:
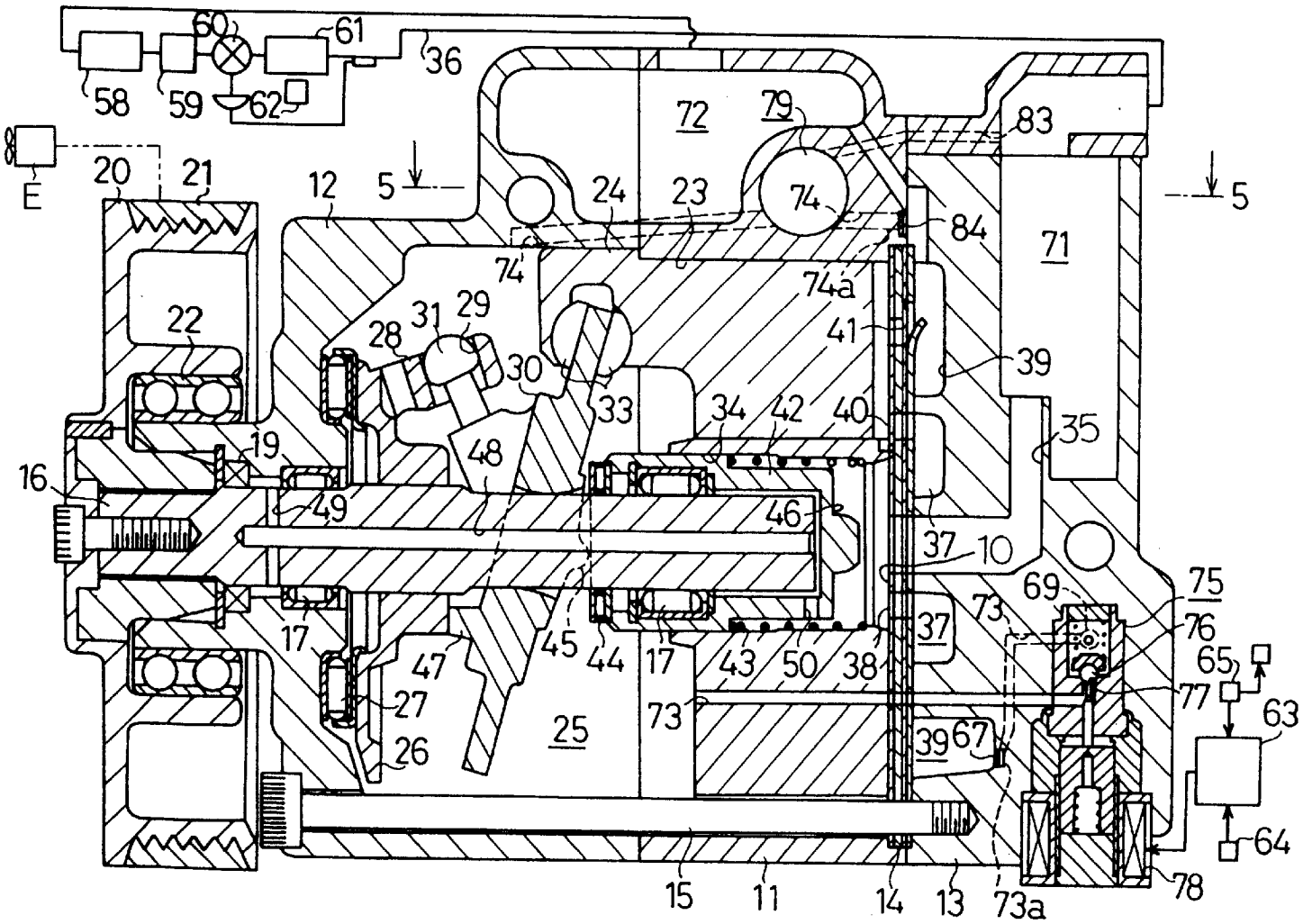
FIG. 4 is a cross-sectional view illustrating a variable displacement compressor according to a second embodiment of the present invention.
Figure 5:
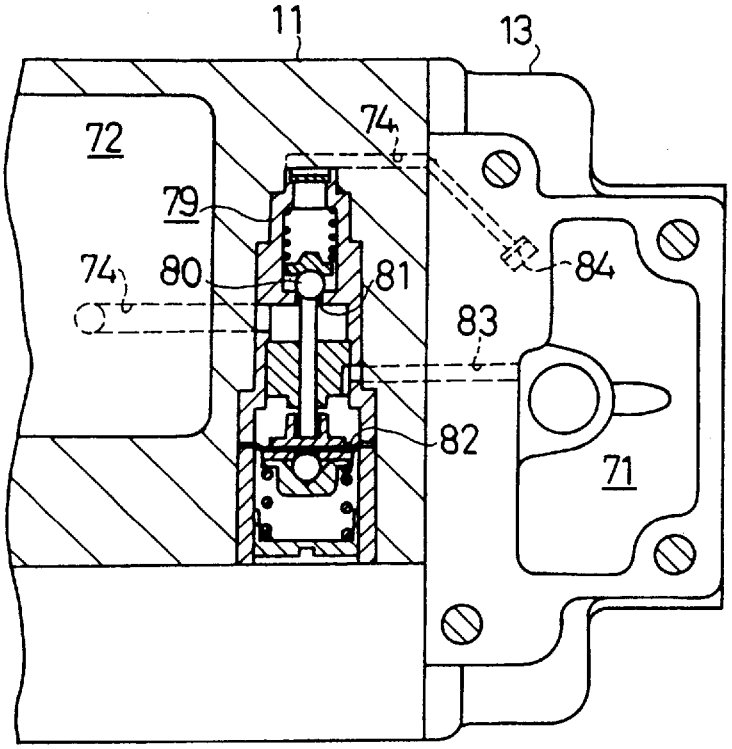
FIG. 5 is a partial cross-sectional view taken along line 5—5 of FIG. 4.

A second embodiment of the present invention will now be described with reference to FIGS. 4 and 5.

In the second embodiment, a suction muffler 71 is defined in the rear housing 13. The suction passage 35 is connected with the external refrigerant circuit 36 via the suction muffler 71. A discharge muffler 72 is defined in the upper portion of the cylinder block 11 and the front housing 12. The discharge chamber 39 is connected to the external refrigerant circuit 36 via the discharge muffler 72.

A first supply passage 73 and a second supply passage 74 communicate the discharge chamber 39 with the crank chamber 25. An electromagnetic valve 75, which constitutes a part of a displacement control valve, is located midway in the first supply passage 73. The electromagnetic valve 75 includes a valve body 76 for selectively opening and closing a valve hole 77 and a solenoid 78 for activating the valve body 76. The computer 63 excites or de-excites the solenoid 78 for closing or opening the valve hole 77 by the valve 76.

An adjusting valve 79, which constitutes another part of the displacement control valve, is located midway in the second supply passage 74. As best seen in FIG. 5, the adjusting valve 79 includes a valve body 80 and diaphragm 82 for controlling the opening amount of a valve hole 81 defined by the valve body 80. The opening is controlled based on the suction acting on the diaphragm 82 via a passage 83. Opening of the electromagnetic value 75 or opening of the adjusting valve 79 allows the refrigerant gas in the discharge chamber 39 to flow into the crank chamber 25 via the supply passages 73, 74. Accordingly, the pressure in the crank chamber 25 is controlled.

In the second embodiment, as in the first embodiment, the first filter 67 is located at the inlet 73*a* of the first supply passage 73 and the second filter 69 is located at the inlet of the electromagnetic valve 75. A third filter 84 is located at the inlet 74*a* of the second supply passage 74.

When the compressor is operating, opening of the electromagnetic valve 75 and the adjusting valve 79 allows the refrigerant gas in the discharge chamber 39 to flow into the crank chamber 25 via the pressure supply passages 73, 74. Foreign matter such as metal powder and carbide mixed with lubricant oil in the refrigerant gas is captured by the filters 67, 69, 84. When the electromagnetic valve 75 and the adjusting valve 79 are closed on the other hand, the gas flow from the discharge chamber 39 to the external refrigerant gas circuit 36 removes foreign matter accumulated on the first and third filters 67, 84. The same effect as the first embodiment is thus achieved in the second embodiment.

Figure 6:
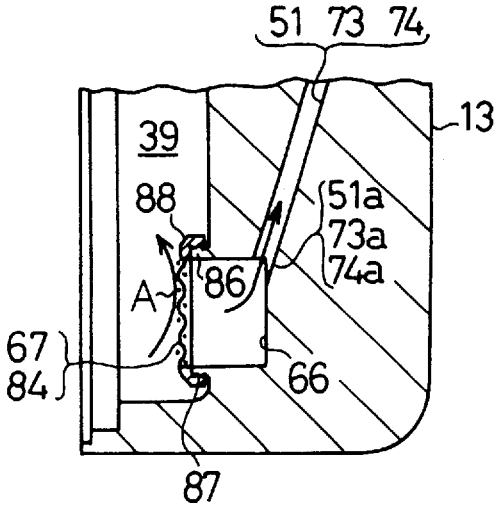
FIG. 6 is an enlarged partial cross-sectional view similar to FIG. 3 illustrating a third embodiment of the present invention.

A third embodiment of the present invention will be described with reference to FIG. 6.

In the third embodiment, a cylindrical protrusion 86 is formed at the opening of the recess 66. The inlets 51*a*, 73*a*, 74*a* of the supply passages 51, 73, 74 according to the first and second embodiments are connected with the recess 66. A screw thread 87 is formed on the periphery of the protrusion 86. A support ring 88 is screwed to the thread 87. Filters 67 and 84 are attached to the ring 88.

The filters 67, 84 are parallel to and slightly protrude from the inner wall of the discharge chamber 39. When the compressor is operating with the supply passages 51, 73, 74 closed, refrigerant gas in the discharge chamber 39 flows along the faces of the filters 67 and 84 as illustrated with an arrow A in FIG. 6. This effectively removes foreign matter on the filters 67, 84. Cleaning of the filters 67, 84 is further improved, accordingly.

Although only three embodiments of the present invention have been described above, it should be apparent to those skilled in the art that the present invention may be embodied in many other specific forms without departing from the spirit or scope of the invention. Particularly, the invention may be embodied in the following forms:

(1) In the first embodiment, the second filter 69 at the inlet of the control valve 52 may be omitted.

(2) In the second embodiment, the second filter 69 at the inlet of the electromagnetic valve 75 may be omitted.

(3) In each of the above embodiments, the attaching structure of the filters 67, 84 to the inlets 51*a*, 73*a*, 74*a* of the supply passages 51, 73, 74 may be modified.

Therefore, the present examples and embodiments are to be considered as illustrative and not restrictive and the invention is not to be limited to the details given herein, but may be modified within the scope of the appended claims.

What is claimed is:

1. A compressor having a cam plate disposed in a crank chamber and mounted on a drive shaft, and a piston coupled to the cam plate and disposed in a cylinder bore, wherein said cam plate converts rotation of the drive shaft to reciprocating movement of the piston in the cylinder bore to vary the capacity of the cylinder bore, said piston thereby compressing any gas supplied to the cylinder bore from an external circuit by way of a suction chamber and discharging the compressed gas to a discharge chamber, said gas containing oil that lubricates the interior of the compressor, wherein said cam plate is tiltable between a maximum inclined angle position and a minimum inclined angle position with respect to a plane perpendicular to the longitudinal axis of the drive shaft according to the differential pressure between the crank chamber and the cylinder bore, and wherein said cam plate varies the stroke of the piston based on the inclination thereof to control the displacement of the compressor, said compressor comprising:

a supply passage for connecting the discharge chamber with the crank chamber to deliver the gas from the discharge chamber to the crank chamber, wherein said supply passage has an inlet that is open in the discharge chamber;

a variable control valve disposed midway in the supply passage, wherein said control valve adjusts the amount of the gas introduced into the crank chamber from the discharge chamber through the supply passage to control the pressure in the crank chamber; and a filter disposed at said inlet of the supply passage to filter the oil, said filter having a surface exposed to the interior of said discharge chamber through which gas containing oil passes when entering the filter, said filter surface being located relative to said discharge chamber interior such that gas when circulating within said discharge chamber flows along parallel to said filter surface to remove foreign matter from said filter surface, said filter capturing foreign matter mixed with the oil when the gas is introduced into the supply passage from the discharge chamber.

2. The compressor according to claim 1 further comprising:

said cam plate assuming the minimum inclined angle position to minimize the displacement of the compressor when the control valve opens said supply passage;

a shutter member for disconnecting the external circuit from the suction chamber when the cam plate is in the minimum inclined angle position; and an internal gas circulating passage defined in the compressor operative upon disconnection of the external circuit from the suction chamber.

3. The compressor according to claim 2, wherein said circulating passage includes said supply passage.

4. The compressor according to claim 3, wherein said circulating passage includes a release passage for connecting the crank chamber with the suction chamber to deliver the gas from the crank chamber to the suction chamber.

5. The compressor according to claim 2, wherein said shutter member is movable between a first position and a second position in response to the inclination of the cam plate, wherein the shutter member connects the external circuit with the suction chamber when the shutter member is in the first position, and wherein the shutter member disconnects the external circuit from the suction chamber when the shutter member is in the second position.

6. The compressor according to claim 2 further comprising an external driving source coupled directly to the drive shaft to operate the compressor.

7. The compressor according to claim 1, wherein said cam plate is in the maximum inclined angle position to maximize the displacement of the compressor when the control valve closes said supply passage at which time the gas circulates in said discharge chamber and flows along parallel to said surface of the filter.

8. The compressor according to claim 7, wherein said discharge chamber has an inner wall, wherein said inlet of the supply passage is open in the inner wall, and wherein said filter is substantially parallel to the inner wall.

9. The compressor according to claim 8, wherein said filter protrudes into the discharge chamber from the inner wall.

10. The compressor according to claim 1, wherein said discharge chamber has a bottom which is at a lowermost point in the compressor when the compressor is mounted in a vehicle, and wherein said inlet of the supply passage is open in the vicinity of the bottom.

11. The compressor according to claim 1, wherein said control valve includes an electromagnetic valve for selectively opening and closing the supply passage in response to operational conditions of the compressor.

12. The compressor according to claim 1, wherein said control valve adjusts the size of the opening of the supply passage in response to the suction pressure.

13. The compressor according to claim 1, wherein said discharge chamber has a recess in a wall thereof which recess is connected with the inlet of the supply passage, said recess having an opening communicating with the discharge chamber which opening has a cross-sectional area larger than that of the supply passage, and wherein said filter is positioned in the opening.

14. A compressor having a drive shaft for coupling the compressor directly to an external driving source for operating the compressor, a cam plate disposed in a crank chamber and mounted on the drive shaft, and a piston coupled to the cam plate and disposed in a cylinder bore, wherein said cam plate converts rotation of the drive shaft to reciprocating movement of the piston in the cylinder bore to vary the capacity of the cylinder bore, said piston thereby compressing any gas supplied to the cylinder bore from an external circuit by way of a suction chamber and discharging the compressed gas to a discharge chamber, said gas containing oil that lubricates the interior of the compressor, wherein said cam plate is tiltable between a maximum inclined angle position and a minimum inclined angle position with respect to a plane perpendicular to the longitudinal axis of the drive shaft according to the differential pressure between the crank chamber and the cylinder bore, and wherein said cam plate varies the stroke of the piston based on the inclination thereof to control the displacement of the compressor, said compressor comprising:

a supply passage for connecting the discharge chamber with the crank chamber to deliver the gas from the discharge chamber to the crank chamber, wherein said supply passage has an inlet that is open in the discharge chamber;

a variable control valve disposed midway in the supply passage, wherein said control valve adjusts the amount of the gas introduced into the crank chamber from the discharge chamber through the supply passage to control the pressure in the crank chamber;

said cam plate assuming the minimum inclined angle position to minimize the displacement of the compressor when the control valve opens said supply passage;

a shutter member for disconnecting the external circuit from the suction chamber when the cam plate is in the minimum inclined angle position;

an internal gas circulating passage defined in the compressor operative upon disconnection of the external circuit from the suction chamber, said circulating passage including said supply passage; and a filter disposed at said inlet of the supply passage to filter the oil, said filter having a surface exposed to the interior of said discharge chamber through which gas containing oil passes when entering the filter, said filter surface being located relative to said discharge chamber interior such that gas when circulating within said discharge chamber flows along parallel to said filter surface to remove foreign matter from said filter surface, said filter capturing foreign matter mixed with the oil when the gas is introduced into the supply passage from the discharge chamber.

15. The compressor according to claim 14, wherein said circulating passage includes a release passage for connecting the crank chamber with the suction chamber to deliver the gas from the crank chamber to the suction chamber.

16. The compressor according to claim 14, wherein said shutter member is movable between a first position and a second position in response to the inclination of the cam plate, the shutter member being constructed to connect the external circuit with the suction chamber when the shutter member is in the first position, and to disconnect the external circuit from the suction chamber when the shutter member is in the second position.

17. The compressor according to claim 14, wherein said cam plate is in the maximum inclined angle position to maximize the displacement of the compressor when the control valve closes said supply passage at which time the gas circulates in said discharge chamber and flows along parallel to said surface of the filter.

18. The compressor according to claim 17, wherein said discharge chamber has an inner wall, wherein said inlet of the supply passage is open in the inner wall, and wherein said filter is substantially parallel to the inner wall.

19. The compressor according to claim 18, wherein said filter protrudes into the discharge chamber from the inner wall.

20. The compressor according to claim 18, wherein said discharge chamber has a bottom, and wherein said inlet of the supply passage is open in the vicinity of the bottom.

21. The compressor according to claim 14, wherein said control valve includes an electromagnetic valve for selectively opening and closing the supply passage in response to operational conditions of the compressor.

22. The compressor according to claim 14, wherein said control valve adjusts the size of the opening of the supply passage in response to the suction pressure.

23. The compressor according to claim 14, wherein said discharge chamber has a recess in a wall thereof which recess is connected with the inlet of the supply passage, said recess having an opening communicating with the discharge chamber which opening has a cross-sectional area larger than that of the supply passage, and wherein said filter is positioned in the opening.

* * * * *